US008359898B2

(12) United States Patent
Huang

(10) Patent No.: US 8,359,898 B2
(45) Date of Patent: Jan. 29, 2013

(54) CONNECTOR STRUCTURE FOR SIGNAL LINE AND CRIMPING TOOL THEREOF

(76) Inventor: Jen-Nan Huang, Taichung (TW)

( * ) Notice: Subject to any disclaimer, the term of this patent is extended or adjusted under 35 U.S.C. 154(b) by 619 days.

(21) Appl. No.: 12/552,065

(22) Filed: Sep. 1, 2009

(65) Prior Publication Data

US 2010/0062657 A1 Mar. 11, 2010

(30) Foreign Application Priority Data

Sep. 5, 2008 (TW) ..... 97134189 A

(51) Int. Cl.
*B24B 7/00* (2006.01)
*B21F 15/00* (2006.01)

(52) U.S. Cl. ..... 72/409.01; 72/409.14

(58) Field of Classification Search ..... 72/407, 72/409.01, 409.5–409.8, 409.11–409.14, 72/412, 416; 81/9.4, 9.41–9.43; 29/566.3, 29/566.4; 30/90.1–91.2
See application file for complete search history.

(56) References Cited

U.S. PATENT DOCUMENTS 4,480,374 A * 11/1984 Meyer ..... 29/566.4
4,625,386 A * 12/1986 Bieganski ..... 29/566.4
4,713,874 A * 12/1987 Schwartz ..... 29/566.4
5,992,002 A * 11/1999 Hung ..... 29/566.4
6,230,387 B1 * 5/2001 Gritters et al. ..... 29/566.4

* cited by examiner

*Primary Examiner* — Teresa M Ekiert

(57) ABSTRACT

Connector structure for signal line and crimping tool thereof comprises a connector with a body having a plurality of passages formed therein for receiving a number of signal lines, and on the top surface adjacent to the rear end of the connector including a press member for pressing the signal lines. The passages includes a plurality of slots extended through the front end of the connector so that the cores of the signal lines can insert through the front end of the body, above the slots is provided with a through groove for inserting a guide member therein. Besides, a crimping tool includes two clippers which are pivotally connected together. Between the clippers is defined with a press mechanism for pressing the guide member and the press member, and the crimping tool includes a cutting mechanism to cut the cores evenly.

8 Claims, 12 Drawing Sheets

CONNECTOR STRUCTURE FOR SIGNAL LINE AND CRIMPING TOOL THEREOF

BACKGROUND OF THE INVENTION

1. Field of the Invention

The present invention relates to a connector structure for a signal line that can cut the cores of the signal line evenly and easily.

2. Description of the Prior

Referring to FIGS. 1 and 2, a signal line 10 and a conventional connector 20 are pressed by a crimping tool, wherein the connector 20 includes a body 21 and a guide member 22, the body 21 is integrally made of transparent material and includes a passage 211 formed therein, and includes a press member 212 pressed into the passage 211. Besides, the passage 211 includes a plurality of closed slots 213 extending to a front end thereof, each slot 213 includes a through groove 214 arranged thereabove to insert a guide member 22 with an end foot 221. The crimping tool 30 includes a first and a second clippers 31 and 32 axially connected together, the first clipper 31 includes a holder 311 mounted thereon and having a positioning recess 312 fixed on the holder 311 to receive the connector 20, and the second clipper 32 includes a coupling plate 321 to abut against the guide member 22 of the connector 20 and a clamping panel 322 to bias against the press member 212 of the body 21, such that as the first and the second clippers 31, 32 are pressed, the guide member 22 and the press member 212 of the connector 20 are pressed, and a blade 323 on one side of the second clipper 32 cuts the signal line 10. In operation, the crimpling tool 30 is used to peel the signal line 10, and then the signal line 10 is placed under the blade 323 of the second clipper 32. Thereafter, the first and the second clippers 31, 32 are pressed and the blade 323 of the second clipper 32 cuts and peels a covering layer 11 of the signal line 10 off so that a plurality of cores 12 of the signal line 10 expose, and then the cores 12 are pulled straight to be cut by using the blade 323, the suitable length of the signal line 10 is inserted the passage 211 of the body 21 so that the cores 12 of the signal line 10 are placed to the slots 213 of the body 21 to be checked whether they are inserted to exact positions to be pressed by the crimping tool 30 further, wherein the connector 20 is placed to the positioning recess 312 of the first clipper 31, and as the first and the second clippers 31, 32 are pressed, the guide member 22 and the press member 212 of the connector 20 are pressed so that an end foot 211 of the guide member 22 pierces an isolation layer of the core 12 to contact with the core 12. The press member 212 bends downward to contact with the covering layer 11 of the signal line 10, hence the signal line 10 and the connector 20 are coupled together securely.

However such a conventional connector and crimpling tool still have the following disadvantages:

1. The cores 12 of the signal line 10 are cut to be inserted to the exact pressing positions. Therefore if the cores are not be cut evenly, they can not be placed to the exact pressing positions so that the guide member 22 contacts with the cores 12.

2. Due to the slots 213 of the passage 211 of the connector 20 are closed, the cores 12 of the signal lines 10 have to be cut evenly first to extend a suitable length, but if the length is too short, it does not contact with the guide member 22, and while the length is too long, it does not abut against the covering layer 11 of the signal line 10, disengaging the signal line 10 from the connector 20 easily.

3. After the cut cores are inserted to the slots 213, the user can not check whether the cores 12 are inserted to the exact pressing positions precisely, causing poor signal contact.

4. If any core 12 does not contact with the guide member 22 of the connector 20, another connector 20 has to be pressed again, causing material and operation costs.

5. The cores 12 are easy to be damaged during cutting process, and the covering layer 11 of the signal line 10 can not be peeled off during improper cutting process.

The present invention has arisen to mitigate and/or obviate the afore-described disadvantages.

SUMMARY OF THE INVENTION

The primary object of the present invention is to provide a connector structure for a signal line and a crimping tool thereof that can cut the cores of the signal line evenly and easily.

Another object of the present invention is to provide a connector structure for a signal line and a crimping tool thereof that can prevent from cutting the cores A connector structure for a signal line according to a preferred embodiment of the present invention comprises:

a body including a passage formed therein to insert a number of signal lines each with a core and having a plurality of slots passing through a front end of the body so that the cores of the signal line extend out of the front end of the body along the slots, and each slot including a through groove communicating with the body to insert the guide members;

a guide members inserted to the through groove of the body so as to be pressed into the slots of the body to contact with the cores of the signal line;

wherein the body is integrally made of plastic material;

wherein the body includes a press member disposed on a top end thereof to be pressed to the passage so as to abut against the signal line;

wherein the body includes a resilient member with an retaining portion mounted on a bottom end thereof;

wherein the guide members is made of metal material;

wherein the guide members includes an end foot to be pressed into the slot of the body, such that as the guide member is pressed, the end foot pierces an isolation layer of the core to contact with the core.

In addition, a crimping tool of a connector structure for a signal line according to a preferred embodiment of the present invention comprises:

a first clipper and a second clipper axially connected together by using a pivotal member;

a first press mechanism defined between the first clipper and the second clipper and including a holder installed onto the first clipper, and including a first positioning recess to receive a first connector, and including a coupling plate connected with the second clipper corresponding to a guide member of the first connector, such that as the first clipper and the second clipper are pressed, the coupling plate is actuated to press the guide member of the first connector;

a cutting first mechanism defined between the first clipper and the second clipper and including a first stopping member to contact with a front end of a first body so that the cores of the signal line are arranged on the first stopping member after extending out of the front end of the first body, and the second clipper being fixed to correspond to a first blade above the first stopping member, hence as pressing the first clipper and the second clipper, the first blade and the first stopping member cut the extended cores evenly;

wherein the shaft includes an elastic element fitted thereon to abut against the first clipper and the second clipper to drive the first clipper and the second clipper to return original positions;

wherein the elastic element is a torsion spring;

wherein the first press mechanism includes a clamping panel connected to the second clipper, such that the first clipper and the second clipper are pressed to actuate the clamping panel to press the press member of the first body;

wherein between the first clipper and the second clipper is defined a second press mechanism;

wherein the second press mechanism includes a second positioning recess to receive of a second connector, and includes a coupling plate and a clamping panel connected to the second clipper, such that as pressing the first clipper and the second clipper, the coupling plate and the clamping panel are actuated to press a guide member of the second connector and the press member of the first body;

wherein between the first clipper and the second clipper is defined a second cutting mechanism;

wherein as the first clipper and the second clipper are pressed, the second cutting mechanism cuts the cores which extending out of second body evenly by using a second blade and a second stopping member;

wherein between the first clipper and the second clipper is defined a peeling mechanism;

wherein the peeling mechanism includes a first and a second engaging portions, the first engaging portion of the first clipper includes a notch to receive the signal line, includes a screw hole adjacent to a front end of the first engaging portion to screw with a bolt, an end portion of the bolt contacts with the second engaging portion of the second clipper, and the second engaging portion of the second clipper includes a blade installed therein in response to the notch of the first clipper.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
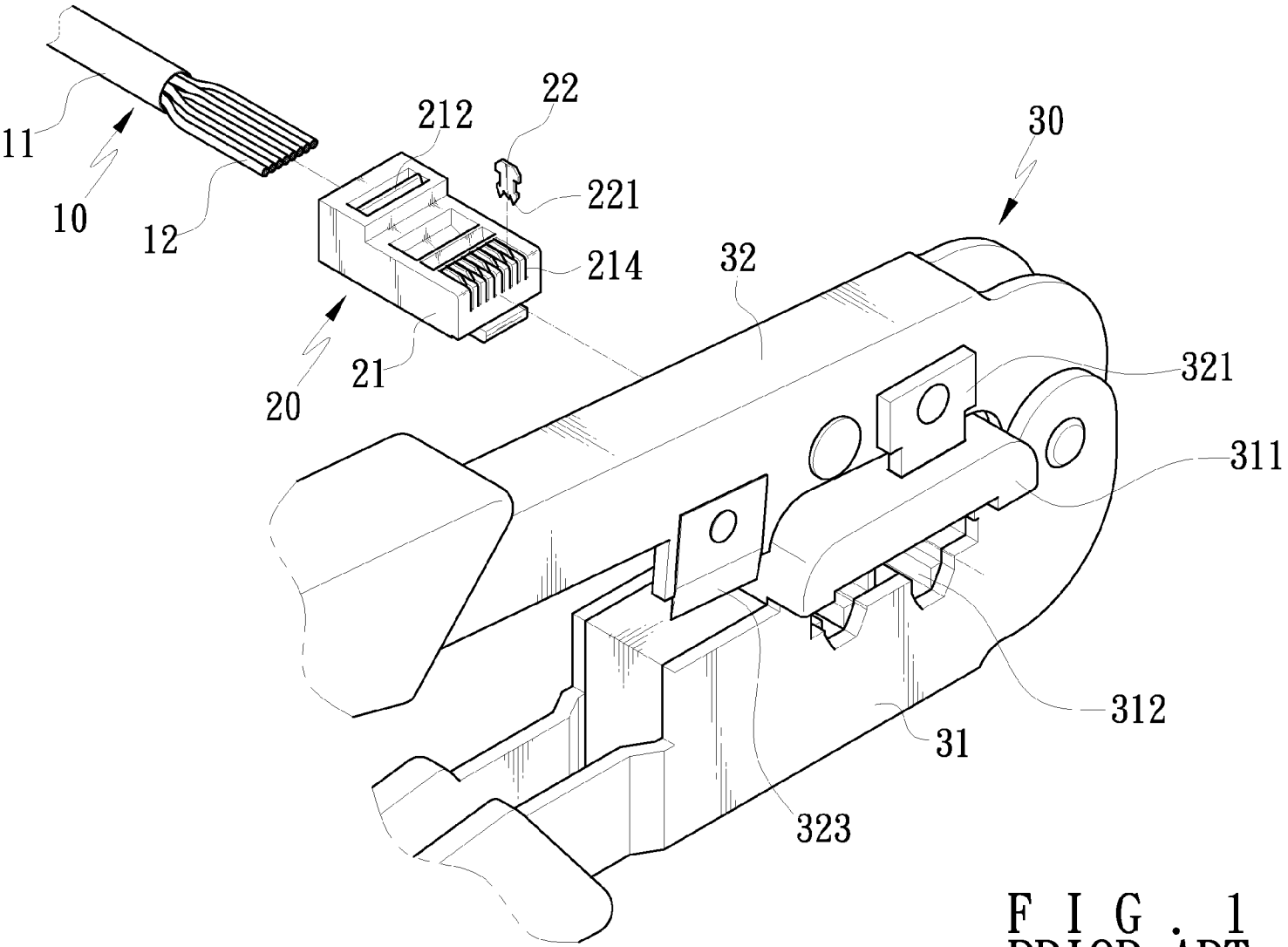
FIG. 1 PRIOR ART
FIG. 1 is a perspective view showing the operation of a conventional connector structure.
Figure 2:
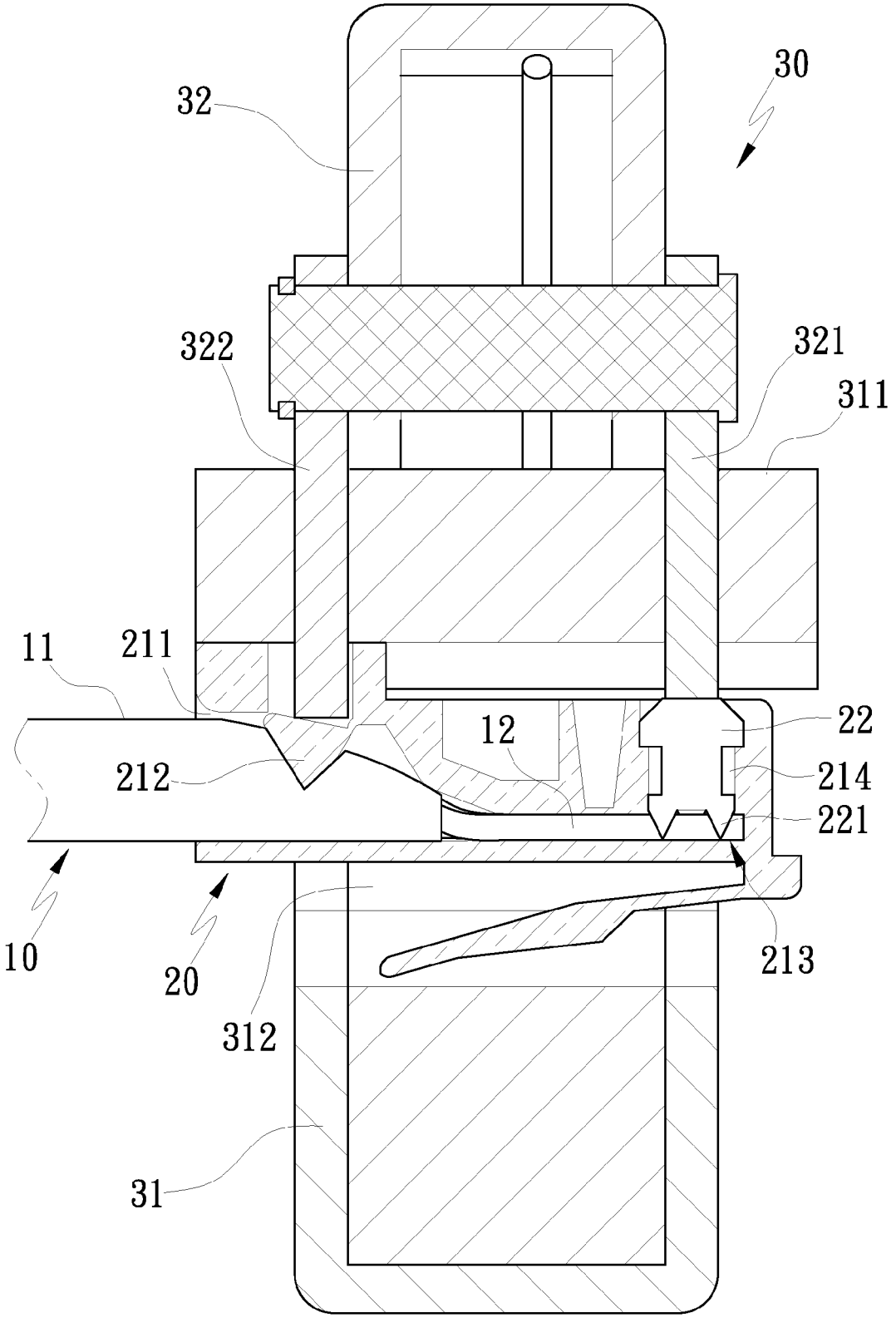
F I G . 2 PRIOR ART
FIG. 2 is a cross sectional view showing the operation of the conventional connector structure.
Figure 3:
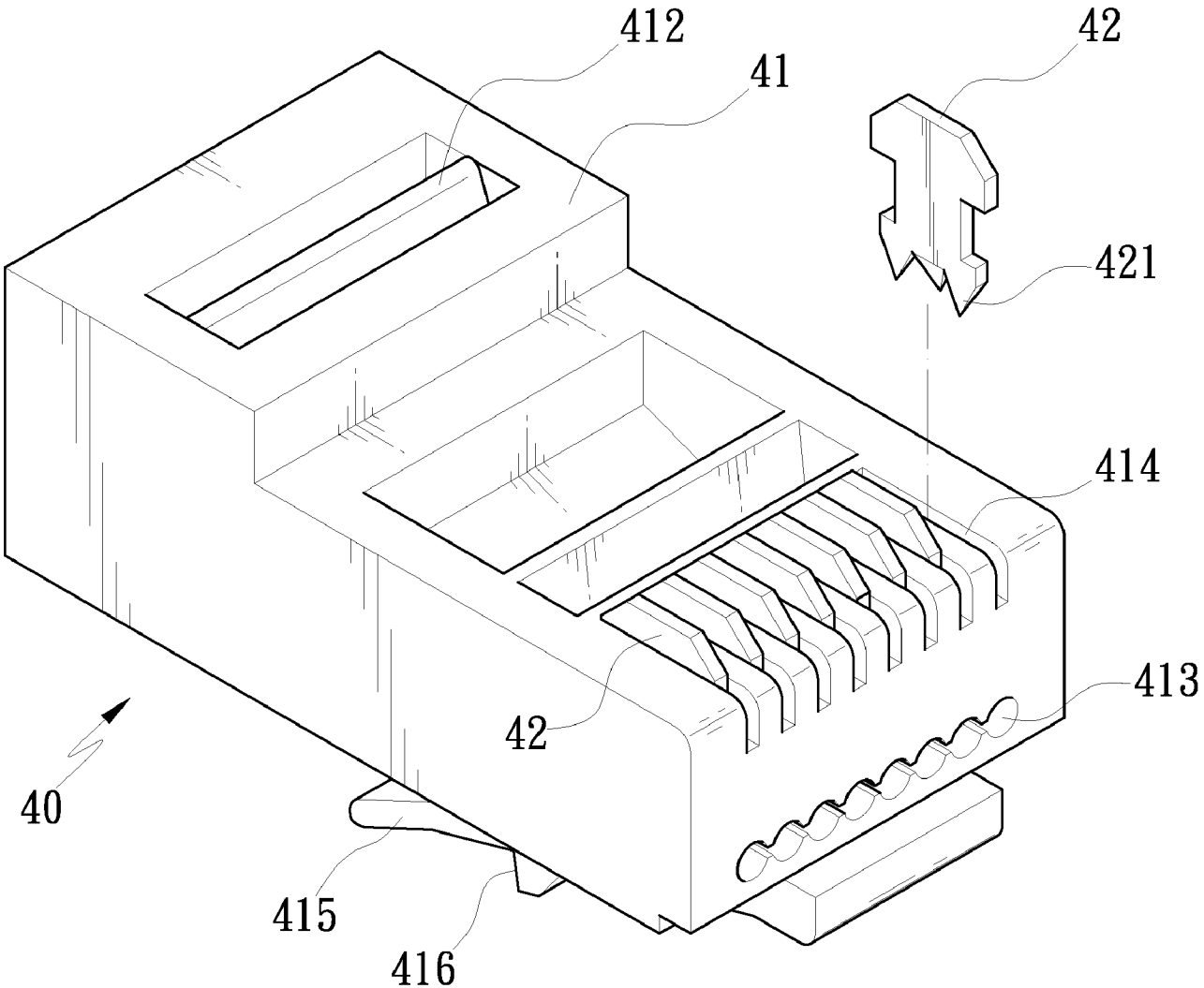
FIG. 3 is a perspective view showing the exploded components of a connector structure in accordance with a preferred embodiment of the present invention.
Figure 4:
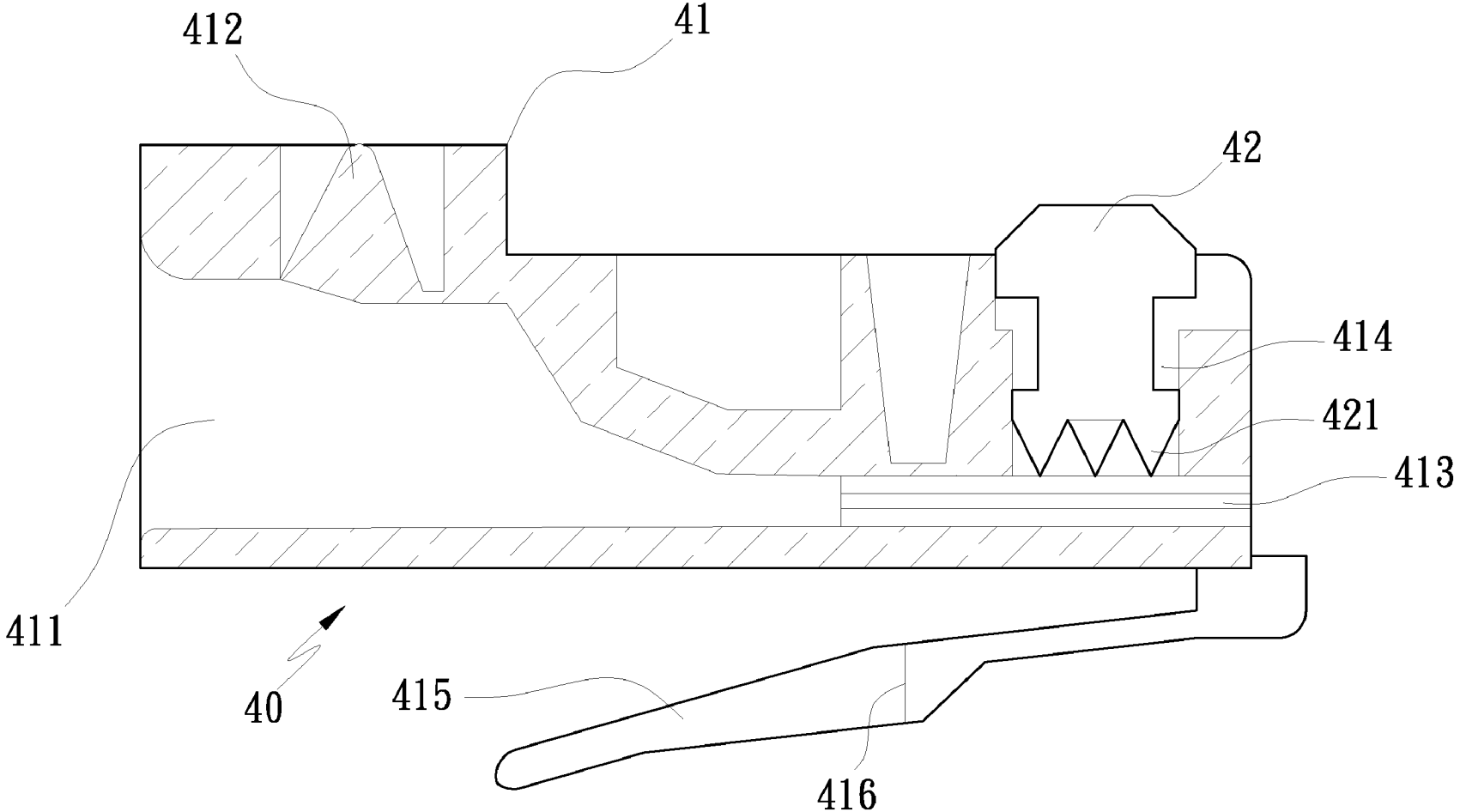
FIG. 4 is a cross sectional view showing the assembly of the connector structure in accordance with the preferred embodiment of the present invention.
Figure 5:
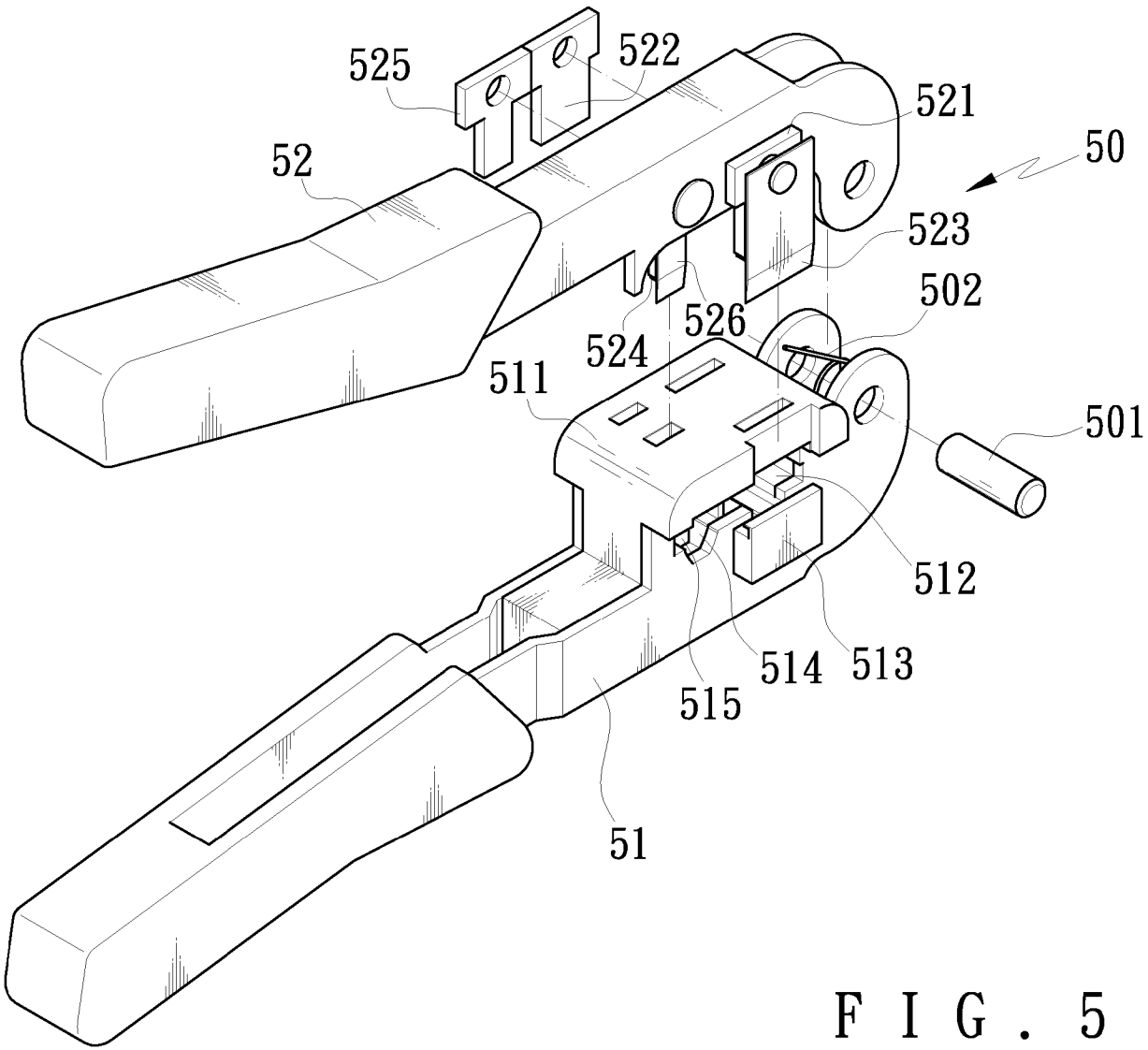
FIG. 5 is a perspective view showing the exploded components of a crimping tool in accordance with the preferred embodiment of the present invention.
Figure 6:
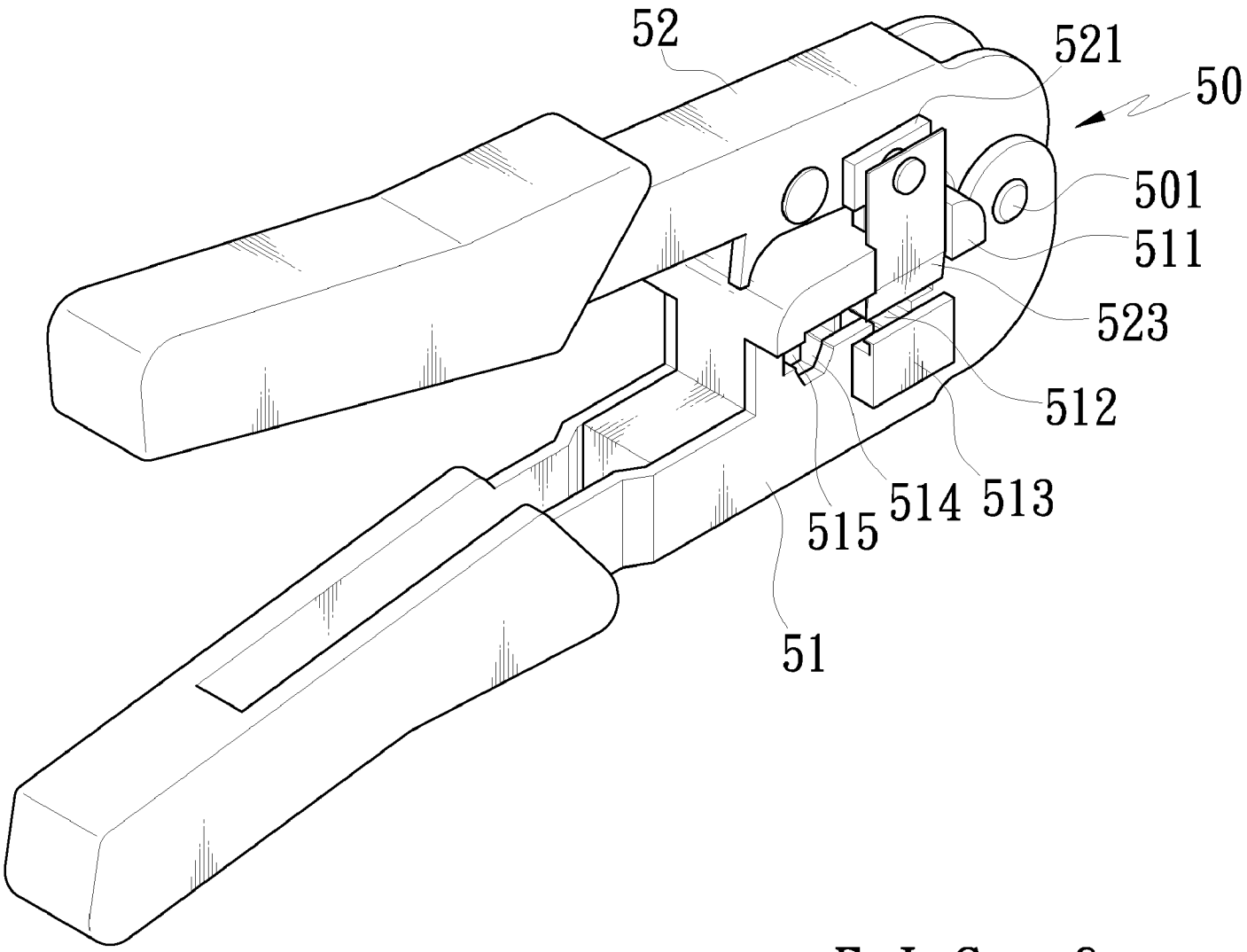
FIG. 6 is a perspective view showing the assembly of the crimping tool in accordance with the preferred embodiment of the present invention.
Figure 7:
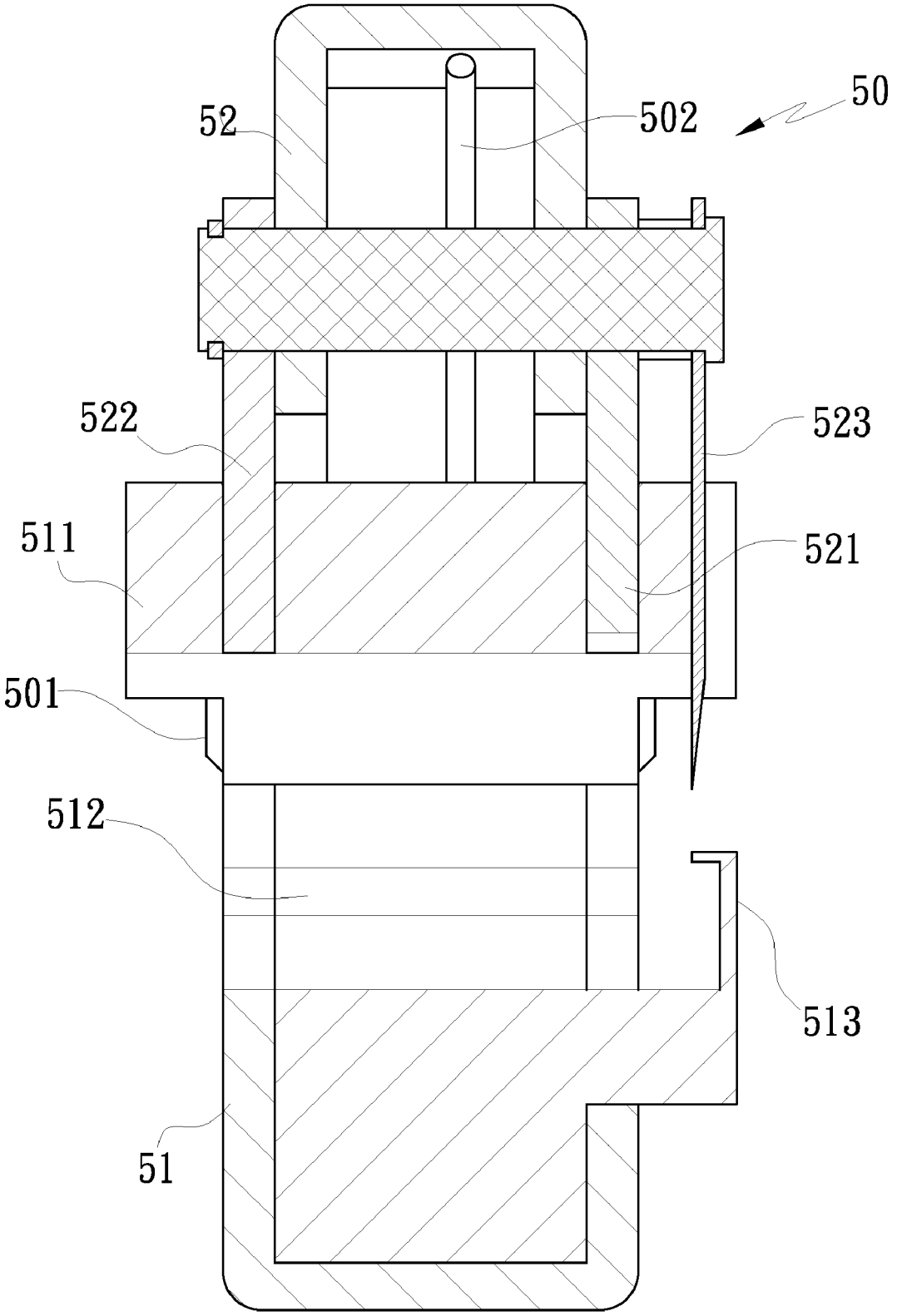
FIG. 7 is a cross sectional view showing the assembly of the crimping tool in accordance with the preferred embodiment of the present invention.

Referring to FIGS. 3 and 4, a first connector 40 according to a preferment embodiment of the present invention comprises: a first body 41 and a plurality of guide members 42, the first body 41 being integrally made of plastic material and including a passage 411 formed therein to insert a number of signal lines each with a core and including a press member 412 disposed on a top end thereof to be pressed to the passage 411 so as to abut against the signal line, the passage 411 including a plurality of slots 413 passing through a front end of the first body 41 so that the cores of the signal line extend out of the front end of the first body 41 along the slots 413, and each slot 413 including a through groove 414 communicating with the first body 41 to insert the guide members 42, each being made of metal material and including an end foot 421 to be pressed into the slot 413 of the first body 41. As the guide member 42 is pressed, the end foot 421 pierces an isolation layer of the core to contact with the core, and the first body 41 includes a resilient member 415 with an retaining portion 416 mounted on a bottom end thereof to be retained a socket.

With reference to FIGS. 4-7, the crimping tool 50 includes a first clipper 51 and a second clipper 52 pivoted together by a shaft 501, and the shaft 501 includes an elastic element 502 fitted thereon to abut against the first clipper 51 and the second clipper 52 to drive the first clipper 51 and the second clipper 52 to return original positions, wherein the elastic element 502 is a torsion spring, and between the first clipper 51 and the second clipper 52 is defined a first press mechanism which includes a holder 511 installed onto the first clipper 51 and includes a first positioning recess 512 to receive the first connector 40, and includes a coupling plate 521 connected with the second clipper 52 corresponding to the guide member 42 of the first connector 40, includes a clamping panel 522 connected to the second clipper 52, such that as the first clipper 51 and the second clipper 52 are pressed, the coupling plate 521 and the clamping panel 522 press the guide member 42 of the first connector 40 and the press member 412 of the first body 41. Furthermore, between the first clipper 51 and the second clipper 52 is defined a first cutting mechanism which includes a first stopping member 513 corresponding to the first positioning recess 512 of the first clipper 51 to contact with the front end of the first body 41 so that the cores of the signal line are arranged on the first stopping member 513 after extending out of the front end of the first body 41, and the second clipper 52 corresponds to a first blade 523 above the first stopping member 513, hence as pressing the first clipper 51 and the second clipper 52, the first blade 523 and the first stopping member 513 cut the extended cores evenly. Between the first clipper 51 and the second clipper 52 is defined a second press mechanism which includes a second positioning recess 514 to receive a second-connector, and includes a coupling plate 524 and a clamping panel 525 connected to the second clipper 52, such that as pressing the first clipper 51 and the second clipper 52, the coupling plate 524 and the clamping panel 525 are actuated to press a guide member of the second connector and the press member of the body. Besides, between the first clipper 51 and the second clipper 52 is defined a second cutting mechanism to cut the cores which extending out of a second body evenly by using a second blade 526 and a second stopping member 515.

Figure 8:
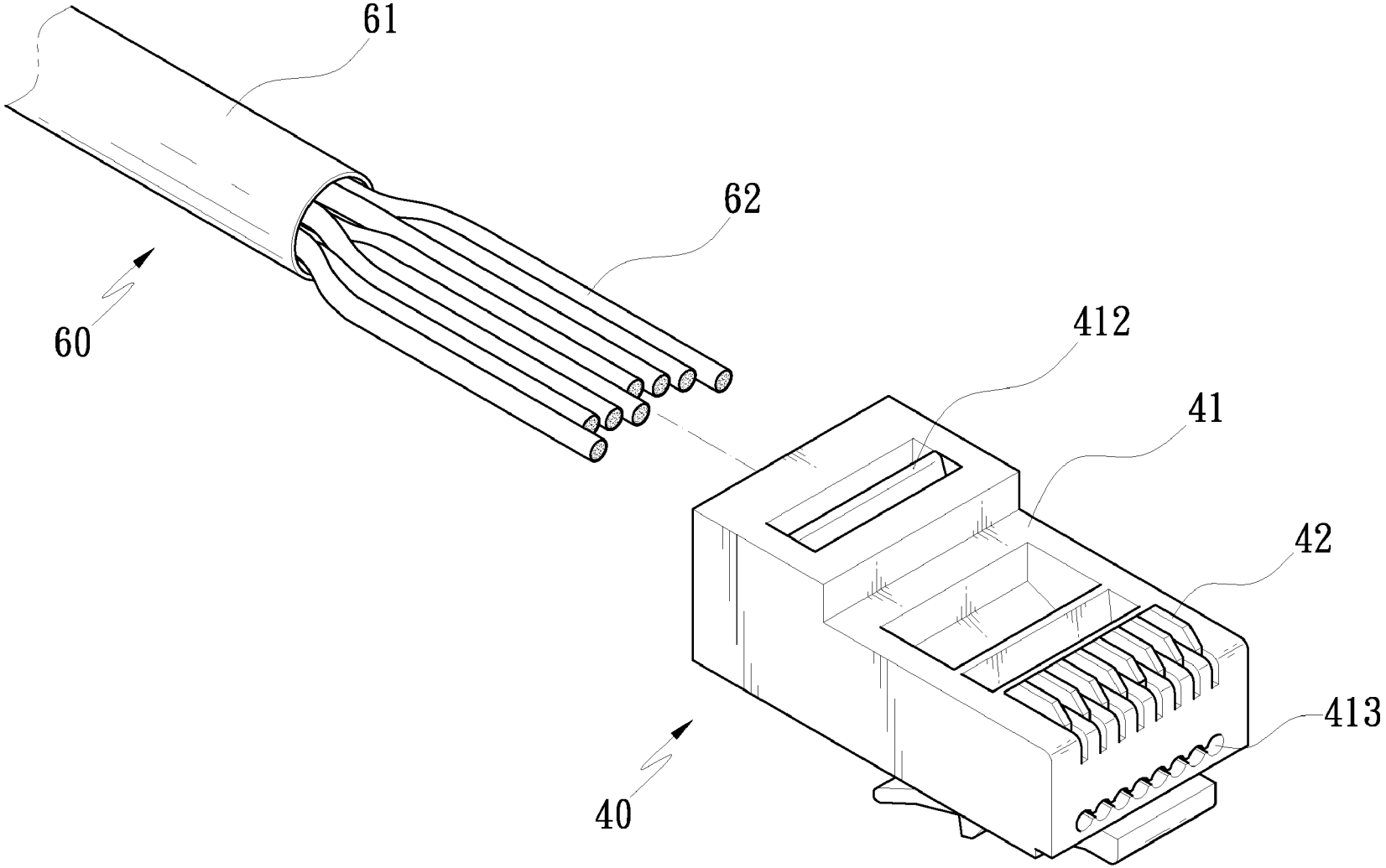
FIG. 8 is a perspective view showing the operation of the connector structure in accordance with the preferred embodiment of the present invention.
Figure 9:
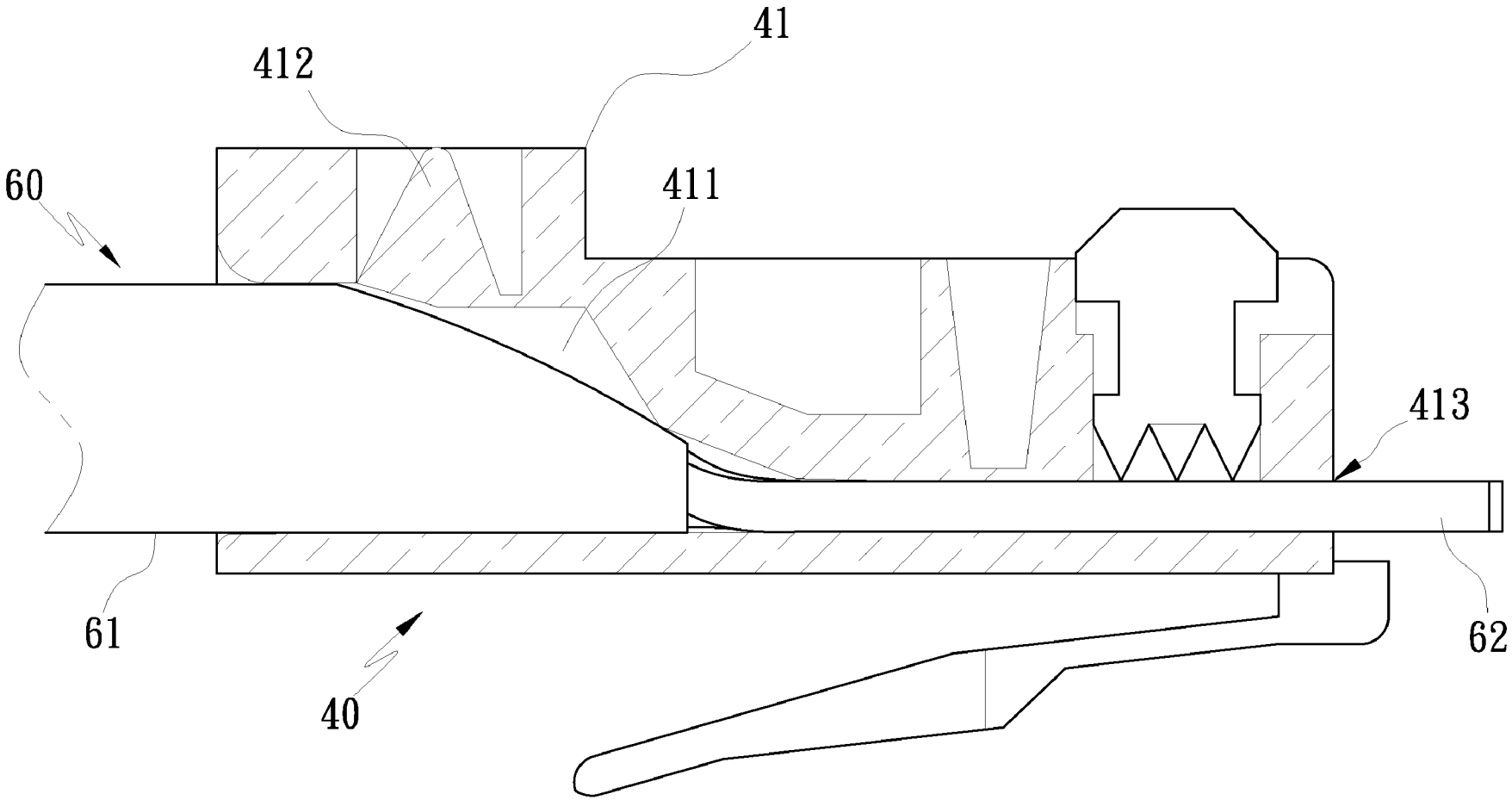
FIG. 9 is a cross sectional view showing the operation of the connector structure in accordance with the preferred embodiment of the present invention.
Figure 10:
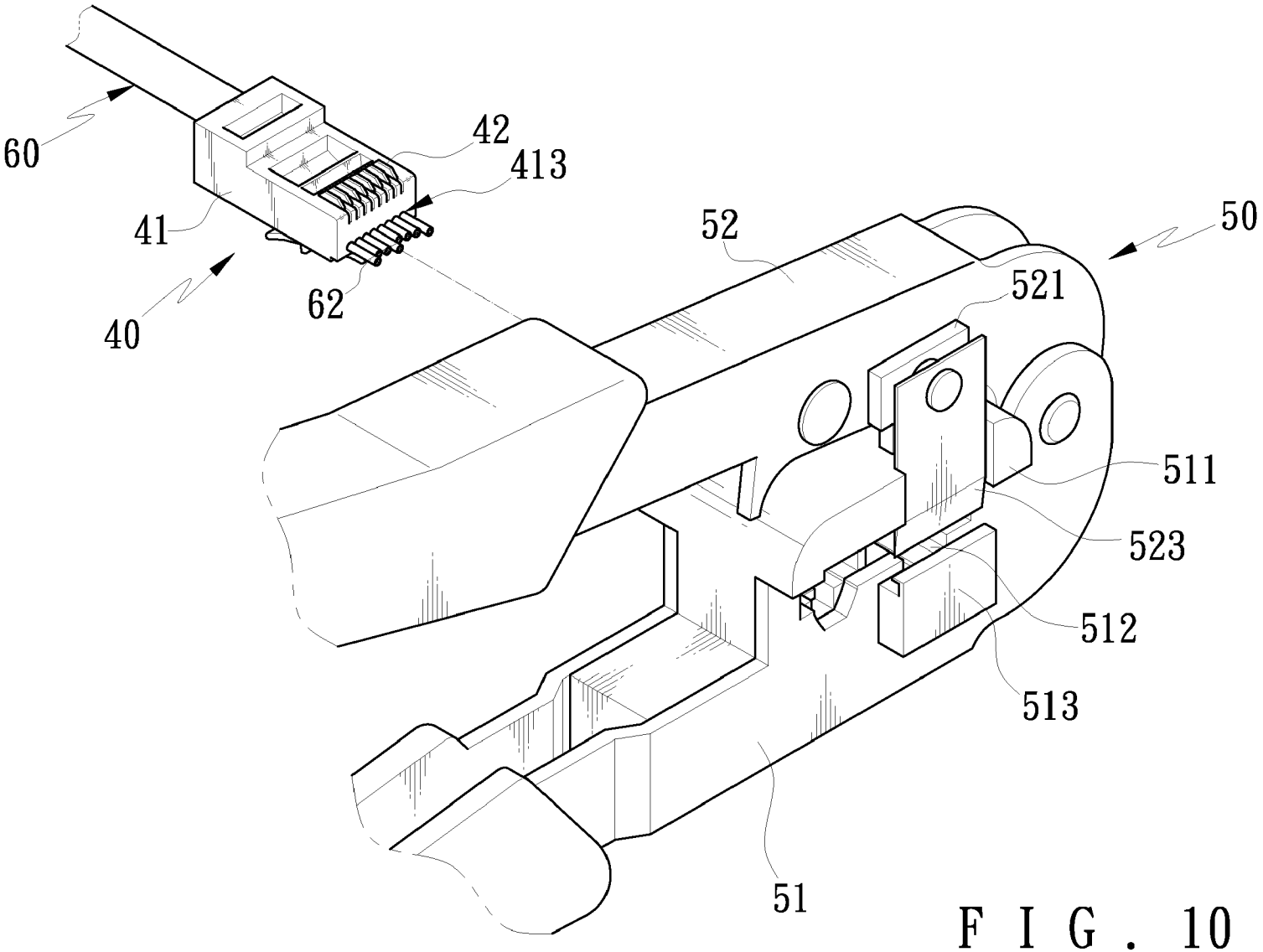
FIG. 10 is a perspective view showing the operation of the connector structure and a crimping tool in accordance with the preferred embodiment of the present invention.
Figure 11:
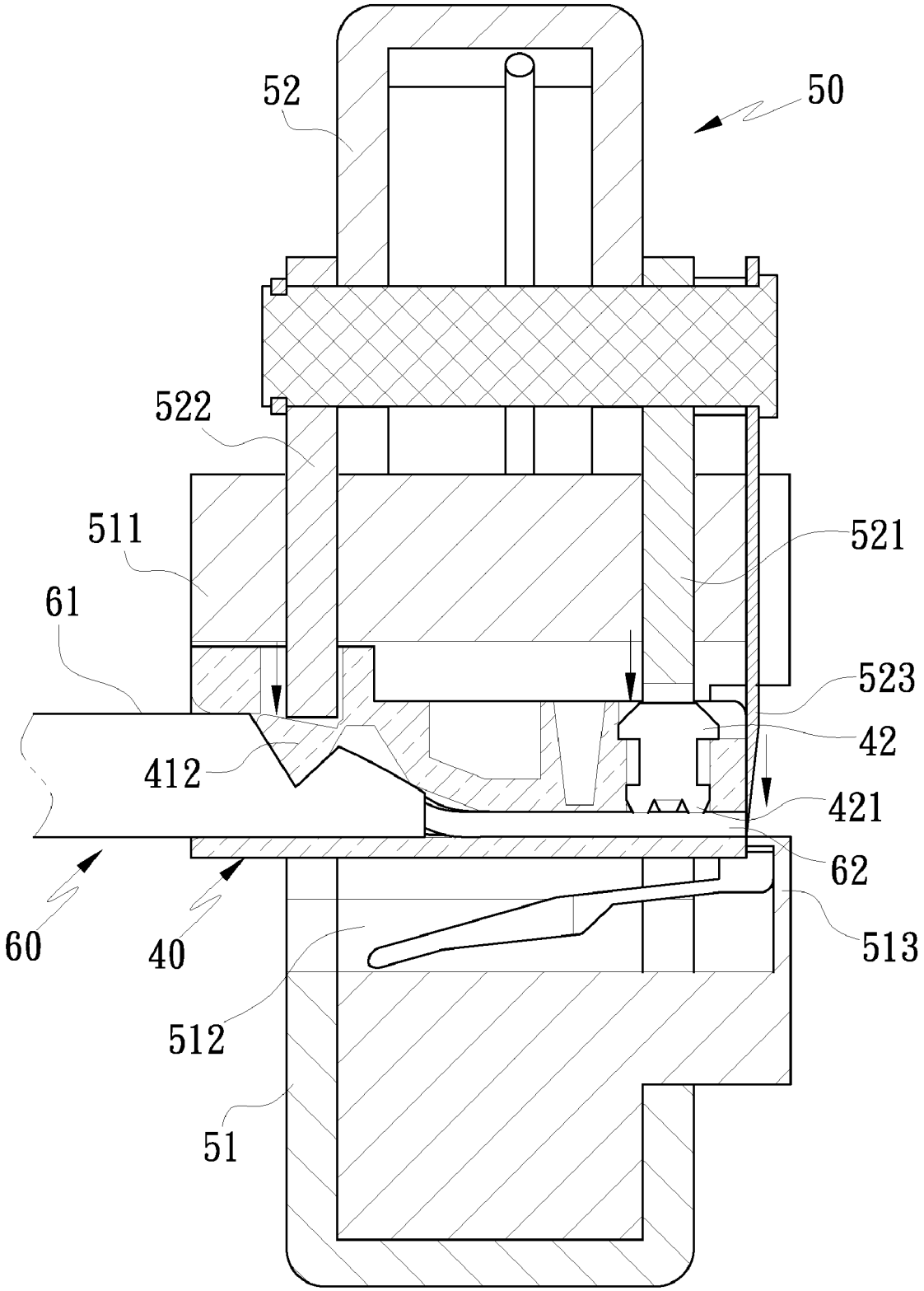
FIG. 11 is a cross sectional view showing the operation of the connector structure and a crimping tool in accordance with the preferred embodiment of the present invention.

As shown in FIGS. 8-9, the operation of pressing the first connector 40 and a signal line 60 includes: peeling the line off, wherein a covering layer 61 of a signal line 60 is peeled off to expose a plurality of cores 62 of the signal line 60, and the cores 62 are pulled straight. Because the slots 413 of the first body 41 are disposed before the passage 411 of the first body 41, before the signal line 60 is inserted to the slot 413 of the first body 41, the cores 62 have not to be cut evenly and the signal line 60 is inserted to the passage 411 of the first body 41 directly, so that the cores 62 extends out of the front end of the first body 41 along the slots 413, and the cores 62 allow to be checked whether they are inserted to desired positions to further insert the signal line 60 so that the covering layer 61 of the signal line 60 is inserted under the press member 412 of the first body 41. Referring to FIGS. 10-11, the first connector 40 and the signal line 60 are crimped by using the crimping tool 50 so that the first connector 40 is placed to the first positioning recess 512, hence the front end of the first body 41 is biased against the first stopping member 513 of the first clipper 51 to press the first clipper 51 and the second clipper 52 together to actuate the coupling plate 521 and the clamping panel 522 of the second clipper 52 to press the guide member 42 of the first connector 40 and the press member 412 of the first body 41. Due to the cores 62 of the signal line 60 extend out of the front end of the first body 41, the cores 62 are located at the slots 413, and during pressing process, an end foot 421 of the guide member 42 pierces the isolation layer of the cores 62 to contact with the cores 62, and the press member 412 of the first body 41 abuts against the covering layer 61 of the signal line 60 to secure the guide member 40 and the signal line 60. In the meantime, the first blade 523 of the second clipper 52 and the first stopping member 513 of the first clipper 51 cut the cores 62 evenly.

Figure 12:
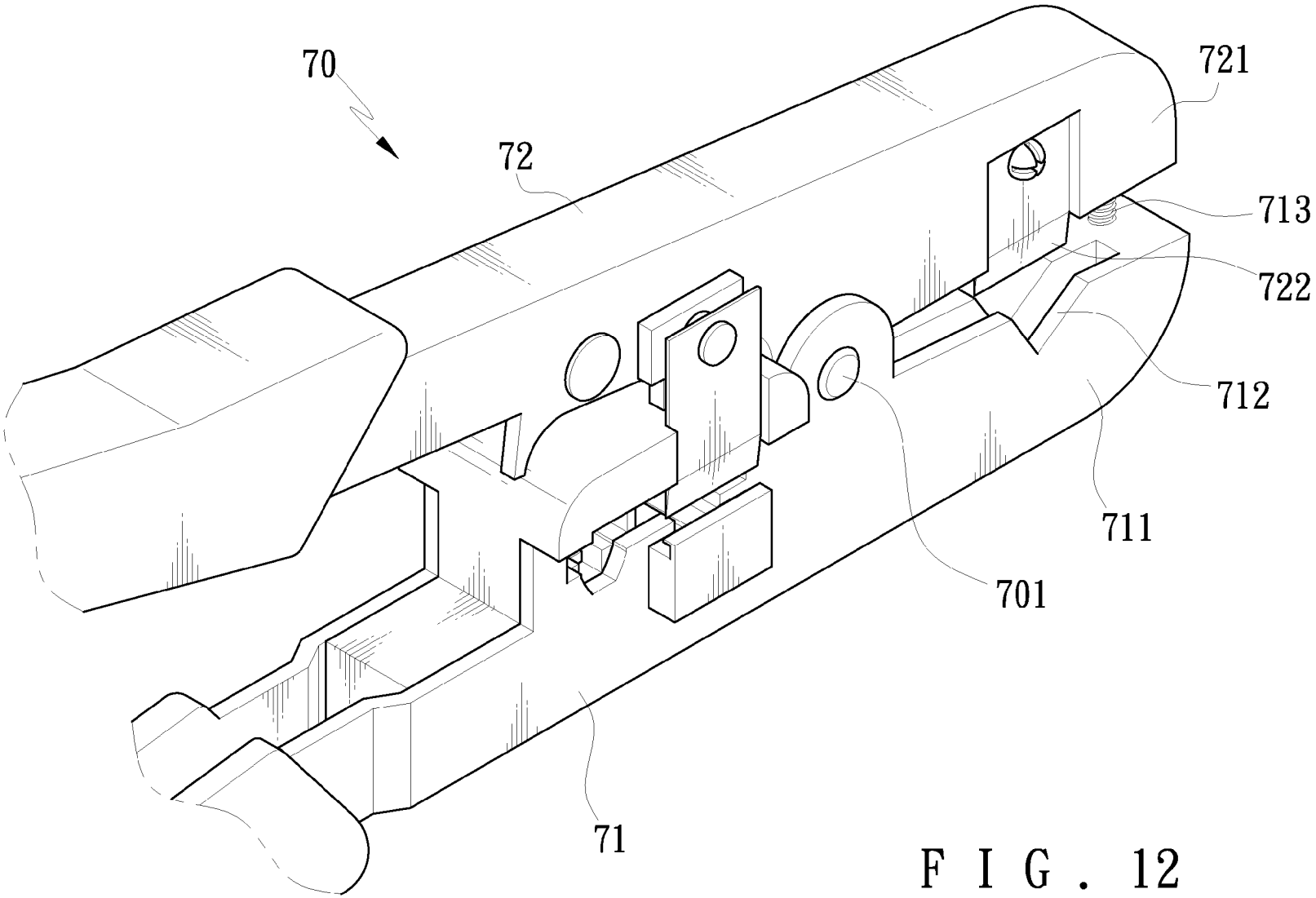
FIG. 12 is a perspective view showing the assembly of another crimping tool in accordance with the preferred embodiment of the present invention.

As illustrated in FIG. 12, a crimping tool 70 according to another preferment embodiment of the present invention comprises: a pivotal member 701, having a resilient element fitted thereon, connected with a first and a second clippers 71, 72 axially so that the first and the second clippers 71, 72 rotate along the pivotal member 701 to return original positions, and between the first and the second clippers 71, 72 on one side of the shaft 701 is defined a press mechanism and a cutting mechanism, between the first and the second clippers 71, 72 on another side of the shaft 701 is defined a peeling mechanism which includes a first and a second engaging portions 711, 721, the first engaging portion 711 of the first clipper 71 includes a notch 712 to receive the signal line, includes a screw hole adjacent to a front end of the first engaging portion 711 to screw with a bolt 713, an end portion of the bolt 713 contacts with the second engaging portion 721 of the second clipper 72. The second engaging portion 721 of the second clipper 72 includes a blade 722 installed therein in response to the notch 712 of the first clipper 72 to rotate the bolt 713, such that an engaging angle between the first and the second engaging portions 711, 721 is controlled to space the notch 712 of the first clipper 71 apart from the blade 722 of the second clipper 72, thus prevent from cutting the cores.

While we have shown and described various embodiments in accordance with the present invention, it is clear to those skilled in the art that further embodiments may be made without departing from the scope of the present invention.

What is claimed is:

1. A crimping tool of a connector structure for a signal line comprises:

a first clipper and a second clipper axially connected together by using a pivotal member;

a first press mechanism defined between the first clipper and the second clipper and including a holder installed onto the first clipper, and including a first positioning recess to receive a first connector, and including a coupling plate connected with the second clipper corresponding to a guide member of the first connector, such that as the first clipper and the second clipper are pressed, the coupling plate is actuated to press the guide member of the first connector;

a first cutting mechanism defined between the first clipper and the second clipper and including a first stopping member to contact with the front end of a first body so that a plurality of cores of the signal line are arranged on the first stopping member after extending out of the front end of the first body, and the second clipper being fixed to correspond to a first blade above the first stopping member, —as pressing the first clipper and the second clipper, the first blade and the first stopping member cut the extended cores evenly;

wherein between the first clipper and the second clipper is defined a peeling mechanism;

wherein the peeling mechanism includes a first engaging portion and a second engaging portion, the first engaging portion includes a notch to receive the signal line, includes a screw hole adjacent to a front end of the first engaging portion to screw with a bolt, an end portion of the bolt contacts with the second engaging portion, and the second engaging portion includes a second blade installed therein to correspond to the notch of the first engaging portion.

2. The crimping tool of the connector structure for the signal line as claimed in claim 1, wherein a shaft includes an elastic element fitted thereon to abut against the first clipper and the second clipper to drive the first clipper and the second clipper to return original positions.

3. The crimping tool of the connector structure for the signal line as claimed in claim 2, wherein the elastic element is a torsion spring.

4. The crimping tool of the connector structure for the signal line as claimed in claim 1, wherein the first press mechanism includes a clamping panel connected to the second clipper, such that the first clipper and the second clipper are pressed to actuate the clamping panel to press a press member of the first body.

5. The crimping tool of the connector structure for the signal line as claimed in claim 1, wherein between the first clipper and the second clipper is defined a second press mechanism.

6. The crimping tool of the connector structure for the signal line as claimed in claim 5, wherein the second press mechanism includes a second positioning recess to receive a second connector, and includes a coupling plate and a clamping panel connected to the second clipper, such that as pressing the first clipper and the second clipper, the coupling plate and the clamping panel are actuated to press a guide member of the second connector and the press member of the first body.

7. The crimping tool of the connector structure for the signal line as claimed in claim 1, wherein between the first clipper and the second clipper is defined a second cutting mechanism.

8. The crimping tool of the connector structure for the signal line as claimed in claim 7, wherein as the first clipper and the second clipper are pressed, the second cutting mechanism cuts the cores which extending out of a second body evenly by using a second blade and a second stopping member.

* * * * *